United States Patent [19]

Swain et al.

[11] 4,040,455

[45] Aug. 9, 1977

[54] AUTOMATIC SHUT OFF FOR GRAVITY FILLING SYSTEM FOR LIQUID STORAGE TANKS

[75] Inventors: Leonard W. Swain, London, Canada; Allen M. Bower, Painsville, Ohio

[73] Assignee: Emco Limited, London, Canada

[21] Appl. No.: 660,995

[22] Filed: Feb. 24, 1976

[51] Int. Cl.[2] ..... B67D 5/00

[52] U.S. Cl. ..... 141/225; 141/346

[58] Field of Search ..... 141/59, 192–229, 141/346–350, 301, 302

[56] References Cited

U.S. PATENT DOCUMENTS

| | | | |
|---|---|---|---|
| 1,725,826 | 8/1929 | Payne | 141/225 |
| 3,005,476 | 10/1961 | Klaus | 141/225 |
| 3,102,555 | 9/1963 | Botkin | 141/225 |

*Primary Examiner*—Houston S. Bell, Jr.
*Attorney, Agent, or Firm*—Fetherstonhaugh & Co.

[57] ABSTRACT

In a liquid loading system for the gravity loading of a liquid storage tank from a tank truck the present invention provides an improved mechanism for interrupting the flow of liquid when the level of liquid in a tank rises above a predetermined level. The structure includes a valve in the fill line which is moveable between an open position and closed position. A pressure responsive latch means is provided for releasably locking the valve in the open position. A vent passage communicates between the pressure responsive latch means and a predetermined level below the upper end of the underground storage tank. A vacuum passage communicates between the vent passage and a vacuum source in the fill line. The flow of liquid through the liquid fill line generates the vacuum in the fill line in the area of the vacuum passage. Until the level of liquid in the underground tank rises above the end of the vent passage, atmosphere from within the tank is drawn into the vacuum passage from the vent passage. When the level of liquid in the tank rises above the end of the vent passage the vacuum pressure is applied to the pressure responsive latch means to release the valve which moves automatically to the closed position to interrupt the flow of liquid.

7 Claims, 7 Drawing Figures

AUTOMATIC SHUT OFF FOR GRAVITY FILLING SYSTEM FOR LIQUID STORAGE TANKS

FIELD OF INVENTION

This invention relates to a system for the gravity filling of liquid storage tanks from tank trucks. In particular this invention relates to a tank truck storage system incorporating an automatic shut-off mechanism which prevents overfilling of storage tanks such as underground storage tanks.

PRIOR ART

Considerable difficulty has been experienced in attempting to prevent over-filling of underground storage tanks at gasoline service stations with the result that spillage is common during the loading of the underground storage tank. This spillage is wasteful, hazardous and causes environmental pollution.

Numerous attempts have been made to overcome this difficulty. However, in most of the prior structures which have been proposed, extensive modification of existing equipment is required.

For a number of years an automatic shut-off nozzle has been used in gasoline service stations for automatically shutting off the supply of gasoline from a gasoline pump to a vehicle when the level of liquid rises above a predetermined level within the tank. This type of nozzle is described in U.S. Pat. No. 3,196,908. In this device a vacuum pressure is established by means of a venturi section within the nozzle. In this apparatus, however, the liquid passes through the nozzle under the pressure of the delivery pump so that no difficulty is experienced in drawing a sufficient vacuum at the venturi to activate the pressure sensitive latching mechanism to release the closure valve when the level of liquid rises above the end of the vent line which is located within the vehicle gasoline storage tank. Although it has been known that this device has operated successfully for some considerable time, it is not possible to employ this system when gravity filling a liquid storage tank such as an underground storage tank because of the low velocities involved. However, it has been discovered that the line extending from the tank truck of the vehicle to the underground storage tank is a syphon in which at certain locations there is a sufficient negative pressure to draw a vacuum sufficient to activate the latching mechanism. This vacuum has been utilized by extending a vent line through the fill line, one end of which opens into the underground storage tank at a predetermined level within the tank and the other end of which communicates with a pressure sensitive latching mechanism. A vacuum passage extends between the vent line and the fill line in order to draw a vacuum in the vent line. The vacuum will normally be vented from within the tank until the level of liquid in the tank rises above the lower end of the vent line whereupon the vacuum will be drawn on the pressure sensitive latching mechanism to release the latching mechanism, thereby causing the shut-off valve to move to the closed position interrupting the flow of liquid into the storage tank.

SUMMARY OF INVENTION

According to one aspect of the present invention, there is provided, in a liquid loading system for the gravity loading of a liquid storage tank from a tank truck having at least one liquid shipping compartment, a liquid fill line opening from the shipping compartment and connected to a liquid input passage of the liquid storage tank, the improvement of; valve means in said line movable between an open position in which the line is open and a closed position in which the line is closed to interrupt the flow of liquid to the storage tank; pressure responsive latch means associated with the valve means for releasably locking the valve in the open position; vent passage means having a first end communicating with said pressure responsive latch means and a second end opening into the storage tank at a predetermined level below the upper end of the tank, and vacuum passage means communicating between the vent passage means and the interior of the flow line whereby the flow of liquid through the fill line during the filling of the storage tank draws a vacuum in the vent line which is insufficient to activate the pressure responsive latch means until the level of liquid in the storage tank rises to close the other end of the vent line whereupon the full vacuum is applied to the pressure response latch means to release the valve which then moves to the closed position.

According to a further aspect of the present invention, the first vent means of the liquid loading system described above comprises a vacuum probe receiver tube mounted coaxially within the upper end of the drop tube by means of at least one rib extending radially inwardly from the drop tube, the vacuum probe receiver tube opening upwardly, a liner tube extending downwardly from the adapter coaxially outwardly of the drop tube to form a passage therebetween which terminates at said predetermined level within the tank, the first vent passage extending longitudinally downwardly from the upper end of the drop tube and radially outwardly through the radially extending arm and opening into the passage formed between the liner tube and the drop tube to terminate at a predetermined level within the tank; the second vent passage means including a vacuum probe mounted at its upper end in a coupler and projecting coaxially with respect to the coupler and adapter to fit within the open end of the vacuum probe receiver tube.

PREFERRED EMBODIMENT

The invention will be more clearly understood after reference to the following detailed specification read in conjunction with the drawings wherein, FIG. 1 is a diagrammatic illustration of the manner in which liquid is discharged from a tank truck to an underground storage tank;

Figure 1:
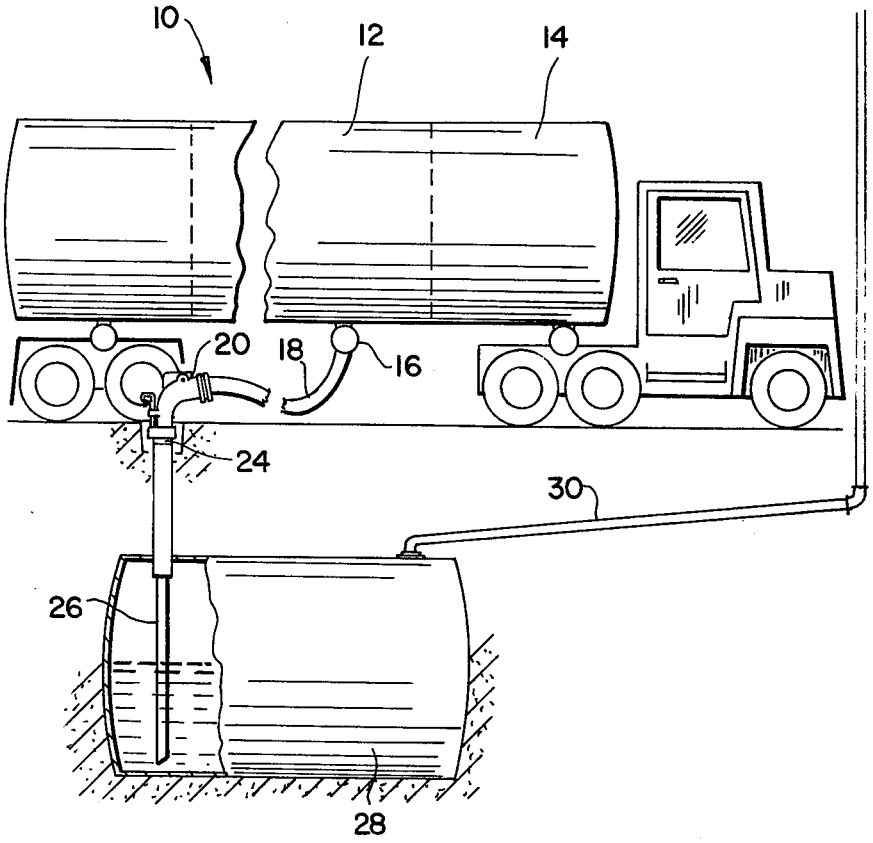

With reference to FIG. 1 of the drawings, the reference numeral 10 refers generally to a liquid loading system according to an embodiment of the present invention. In this system, liquid from a shipping compartment 12 of a tank truck 14 is discharged through the valve 16, filling hose 18, coupler 20, adapter 24 and fill pipe or drop tube 26 to underground storage tank 28. The underground storage tank 28 is provided with a conventional vent line 30 which communicates between the tank 28 and atmosphere.

The system described above is the conventional filling system wherein the operator must remain in attendance during the filling operation and must close the valve 16 immediately on receipt of a signal that the underground storage tank 28 is full or substantially full. Systems have previously been developed in which the rising level of liquid in the tank serves to signal the fact that the tank is substantially full and in some known systems there is provided an automatic control for stopping the flow of liquid when the level rises above the maximum required fill height. The present invention achieves the required automatic shut-off by providing a valve member generally identified by the reference numeral 32, a pressure responsive latching mechanism generally identified by the reference numeral 34, and a vent passage 36 together with a vacuum passage 38.

In use, liquid flowing through the coupler 20 and fill pipe 26 draws a vacuum in the vacuum passage 38. Atmosphere from within the underground storage tank 28 is drawn upwardly through the vent passage 36 and into vacuum passage 38. This condition will continue to exist until the level of liquid in the tank rises above the lower end of the passage 36 whereupon the vacuum pressure in the line 38 will be transmitted through the passage 40 to the pressure responsive latch mechanism to release the latch mechanism to cause the latch mechanism to release the valve member 32, whereupon the valve member 32 will move to a position closing the through passage of the coupler 20 thereby stopping the flow of liquid.

Figure 2:
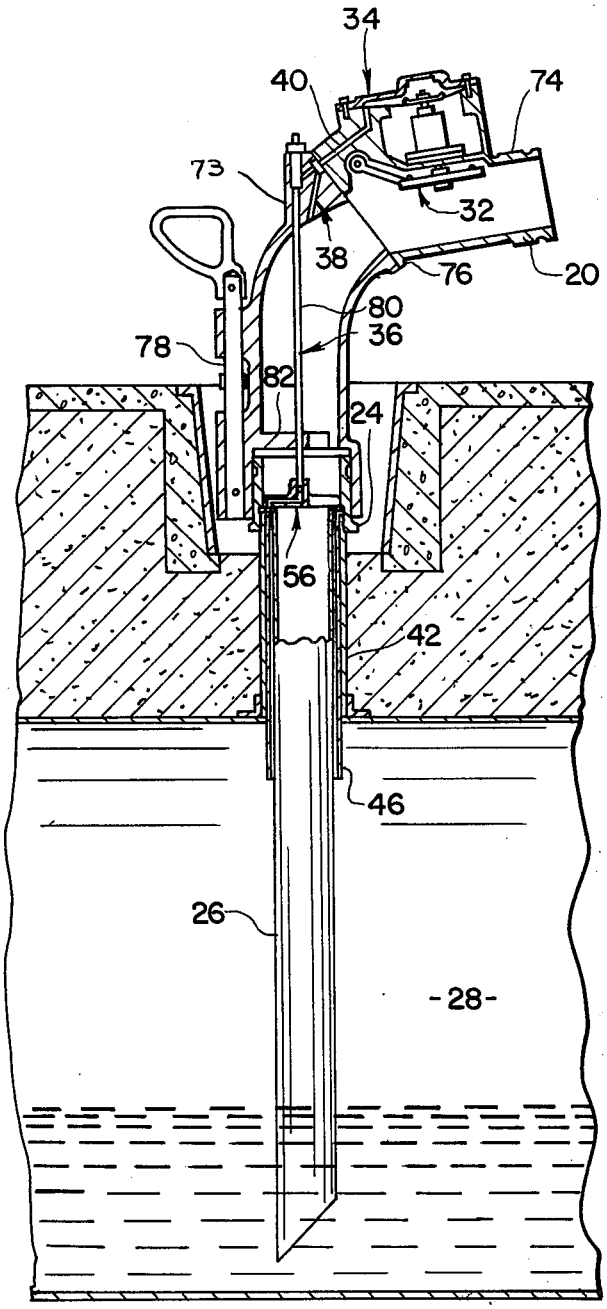
FIG. 2 is a longitudinal section through a coupler and its associated adapter, filling tube and underground storage tank.
Figure 6:
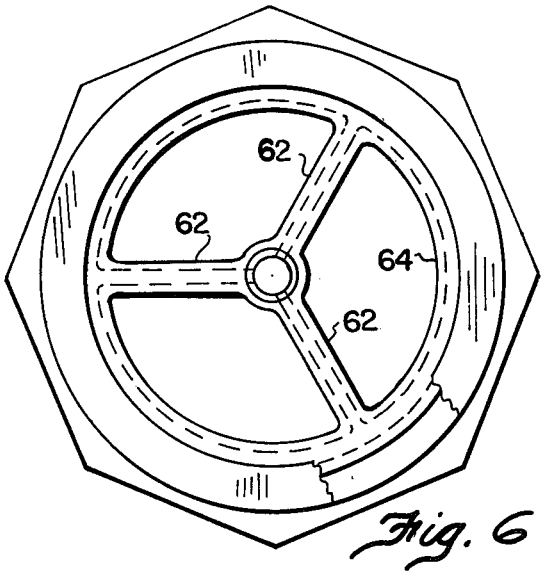
FIG. 6 is a plan view partially sectioned of the adapter.
Figure 7:
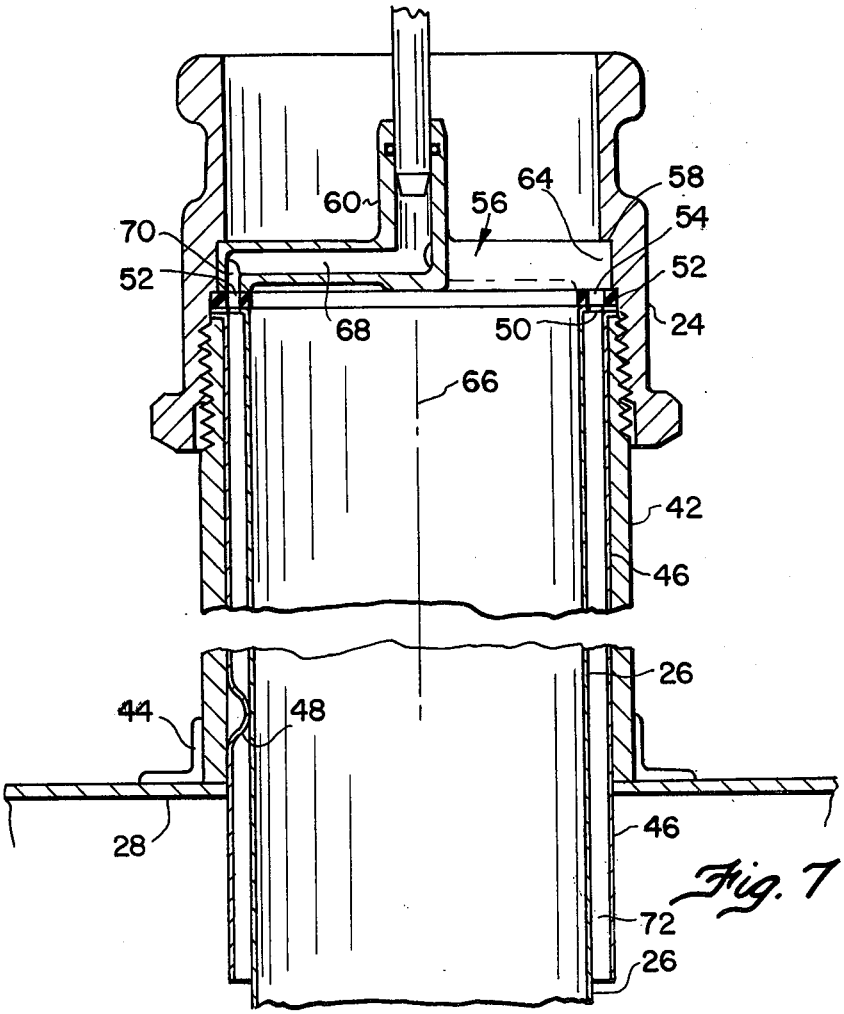
FIG. 7 is a longitudinal sectional view of the adapter and its associated riser tube and filling pipe.

The structure of the adapter 24, drop tube 26 and the first vent means which forms the lower portion of the vent passage 36 is illustrated in FIGS. 2, 6 and 7 of the drawings. As shown in FIG. 7, the adapter member 24 is threadably mounted in the upper end of the riser pipe 42 which is secured with respect to the underground storage tank 28 by means of a collar 44. A liner tube 46 has a narrow flange at the upper end thereof which projects radially outwardly over the upper end of the riser pipe 42. The liner 46 extends downwardly into the storage tank 28 to a predetermined level below the upper end of the tank 28. The liner 46 has a plurality of dimples 48 located about the periphery thereof and projecting inwardly therefrom. The dimples 48 serve to center the drop tube 26. The drop tube 26 has a narrow flange at the upper end thereof which projects radially outwardly to a position overlying the flange of the liner tube 46. The flange at the upper end of the drop tube 26 is formed with a plurality of passages 50 which open therethrough. A resilient annular sealing ring 52 is located above the flange of the drop tube and has passages 54 located therein which are aligned with the passages 50 of the drop tube 26.

A vacuum probe receiver generally identified by the reference numeral 56 is located in the adapter and is clamped between the shoulder 58 of the adapter and resilient sealing ring 52. The vacuum probe receiver consists of a receiver tube 60, three radially extending support arms 62 and a circumferentially extending ring 64. The vacuum probe receiver tube 60 is located on the central axis 66 of the adapter and is supported in this position by means of the arms 62 which radiate inwardly from the ring 64. Vent passages 68 extend through the vacuum probe receiver tube 60 and each of the arms 62 and communicate with a circumferentially extending passage 70 in the lower face of the ring 64. The drop tube 26 is spaced inwardly from the liner tube 46 to provide a vent passage 72 therebetween. As will be apparent from FIG. 2 of the drawings, the vent passage 72 communicates with the passage 50 in the upper flange of the drop tube, the passage 54 in the resilient ring 52, and the passages 70 and 68 of the vacuum probe receiver member 56. These passages together form the first vent passage means which forms a permanent fixture at the underground storage tank. It will be apparent that atmosphere from within the underground storage tank can be drawn through this first vent passage means until the level of liquid in the storage tank rises above the lower end of the liner tube 46 to close the lower end of the vent passage 72.

Figure 3:
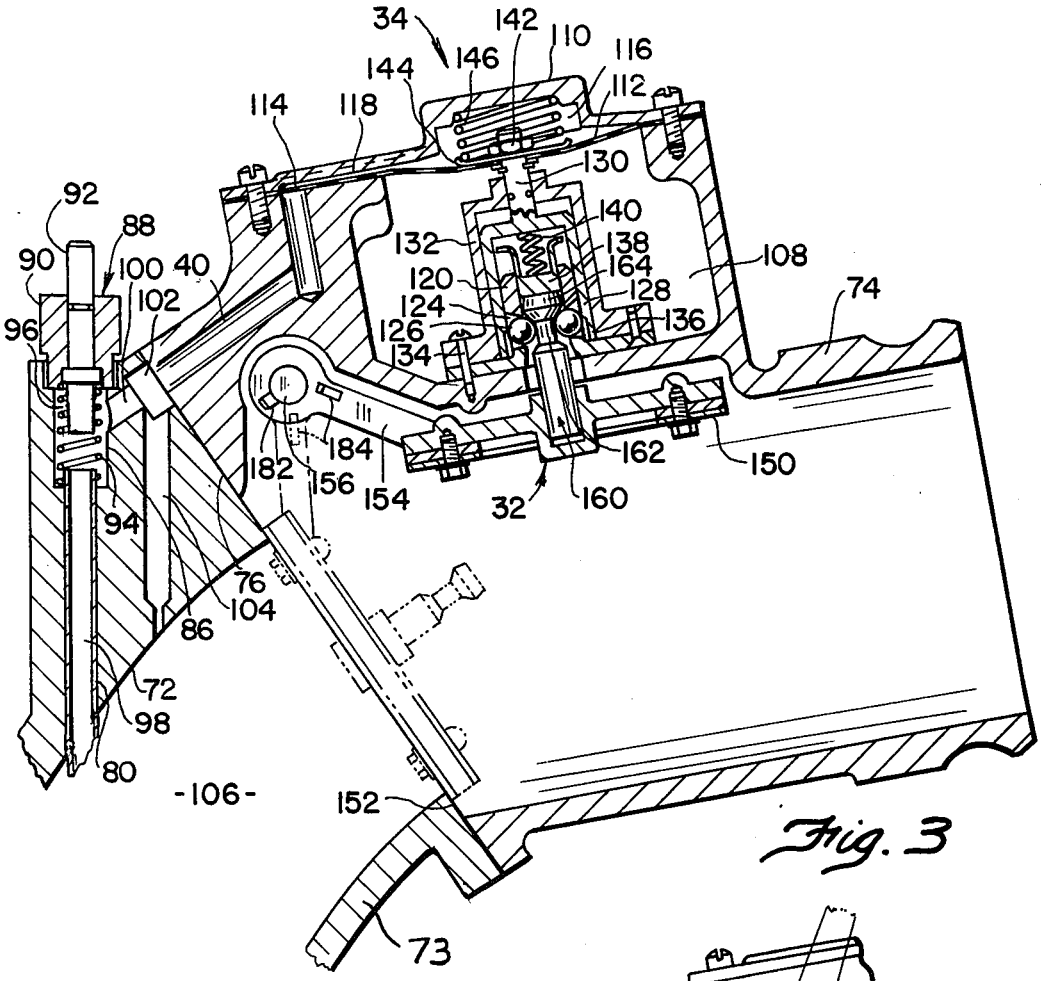
FIG. 3 is an enlarged sectional view of the pressure responsive latching means of the coupling member.
Figure 5:
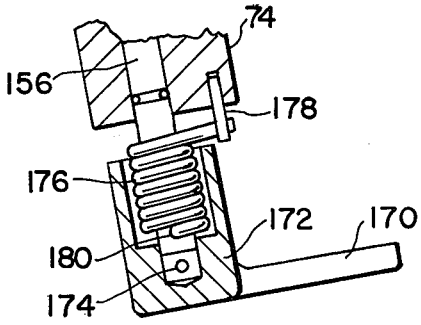
FIG. 5 is a sectional view taken along the line 5—5 of FIG. 4.

The vent passages which extend through the coupler are best illustrated with reference to FIGS. 2 and 3 of the drawings. As shown in FIG. 2 of the drawings, the coupler member 20 consists of a body portion 73 and a head portion 74 connected to one another at an interface 76. The coupler 20 is adapted to be releasably secured with respect to the adapter 24 by means of a conventional locking mechanism 78. A vacuum probe tube 80 has its upper end secured in the body portions 73 and extends downwardly therefrom in alignment with the vacuum probe receiver 56. The lower end of the probe 80 is centered with respect to the lower end of the coupler by means of a plurality of circumferentially spaced arms 82 which extend radially inwardly from the side walls of the coupler. As shown in FIG. 3 of the drawings, the upper end of the probe tube 80 is located in a recess 86 within which a manually operated valve mechanism 88 is located. The valve mechanism 88 includes a mounting collar 90 and a valve member 92 slidably mounted therein. The valve member 92 is urged upwardly away from the upper end of the tube 80 by means of a spring 94. The valve member 92 has a seal 96 at the lower end thereof. The valve member 92 is slidable with respect to the collar 90 for movement towards and away from engagement with the upper end of the probe tube 80 to close the upper end of the probe tube 80 as required in use. The vacuum probe 80 has a passage 98 extending therethrough which may be closed by the valve member 92 as previously described. A further passage 100 opens from the passage 86 to a passage 102 located at the interface 76. A vacuum passage 104 opens from the passage 102 directly into the through passage 106 of the coupler member 20. The vacuum passage 104 has a portion of reduced diameter at the outer end thereof.

The vent passage 40 of the head portion 74 of the coupler communicates with the passage 102 and is therefore is communication with the passage 100 and the vacuum passage 104.

The pressure responsive latch mechanism 34 is illustrated in FIG. 3 of the drawings. As shown in FIG. 3 of the drawings, the head portion 74 of the coupler has a latching chamber 108 located therein, the upper end of which is closed by a head plate 110. A resilient diaphragm 112 is clamped between the head plate 110 and the upper end of the latching chamber 108. The diaphragm 112 has a passage 114 located therein which communicates with the passage 40 in the head. The passage 114 communicates with the upper diaphragm chamber 116 by means of a passage 118.

The latching mechanism includes a ball support member 120 which has a plurality of ball receiving passages 124 extending therethrough. A ball 126 is located in each of the passages 124. A ball retainer member 128 is slidably mounted on the outer face of the support member 120 and has a stem portion 130 projecting upwardly therefrom. A latch supporting housing 132 is located outwardly from the retainer member 128. The releasable latch assembly is secured with respect to the bottom wall of the latching chamber 108 by means of a plurality of mounting screws 134. The ball retainer member 128 has a portion 136 of increased diameter at the lower end thereof. A ball spacer member 138 is slidably mounted within the bore of the ball mounting member 124 and is urged downwardly therein by means of a compression spring 140. A peripheral flange at the upper end of the ball spacer member 138 serves to limit the downward movement of the ball spacer member. The stem 130 of the ball retainer 128 is secured to the flexible diaphragm 112 for movement therewith by means of a locking nut 142. A spring base plate 144 is secured with respect to the stem 130 by the nut 142 and a compressing spring 146 bears against the spring base plate 144 and the head 110 to urge the flexible diaphragm 112 and the ball retainer member 128 downwardly.

The valve member 32 is in the form of a circular disc having an annular sealing member 150 mounted at the edge thereof for engagement with the valve seat 152 formed at the interface 76 between the body portion 73 and the head portion 74 of the coupler. When the valve member 32 is in the position shown in broken lines in FIG. 3, the through passage 106 of the coupler is closed to prevent the flow of liquid therethrough. The valve member is pivotably mounted by means of a pair of pivot arms 154 (only one of which is shown) on a pivot shaft 156 which is mounted to rotate in the head 74. The valve member 32 has a valve stem 160 projecting upwardly therefrom. The valve stem 160 has a neck portion of reduced diameter 162 formed with tapering shoulders at opposite ends thereof and a head portion 164 at the upper end thereof. When the valve is in the open position shown in FIG. 3, the valve stem is locked within the latching mechanism by the balls 126 which project into the neck portion 162. The balls are prevented from moving outwardly by means of the ball retaining member 128. When the full force of the vacuum is drawn in the line 40 and transmitted to the chamber 116 above the diaphragm 112, the reduction in pressure in the chamber 116 causes the diaphragm 112 to move upwardly to compress the spring 146.

The upward movement of the diaphragm 122 raises the stem 130 and the ball retainer member 128 so that the enlarged end portion 136 of the ball retainer is aligned with the balls 126. The tapered shoulder of the valve stem 160 forces the balls 126 radially outwardly into the enlarged portion 136, thereby permitting the head 164 of the valve stem to drop to permit the valve 32 to move to a closed position. As the head portion 164 moves downwardly past the balls 126, the ball spacer member 138 follows it and serves to prevent the balls 126 from moving inwardly after the head 164 has passed downwardly therebetween. In order to return the valve member 32 to the open position, it is manually moved towards the open position, as will be described hereinafter, and the valve stem 160 reenters the central passage formed in the latching mechanism. The head 164 of the stem engages the ball spacer member 138 and forces it upwardly by compressing the spring 140. When the neck portion of the stem is aligned with the balls 126, the balls 126 will be driven inwardly towards the neck 160 when the pressure in the vacuum chamber 116 is relieved to the extent that the spring 146 pushes the ball retainer member downwardly to force the balls 126 inwardy towards the neck 162. When the balls 126 are located in this position, the valve member 32 will once again be locked in the open position.

Figure 4:
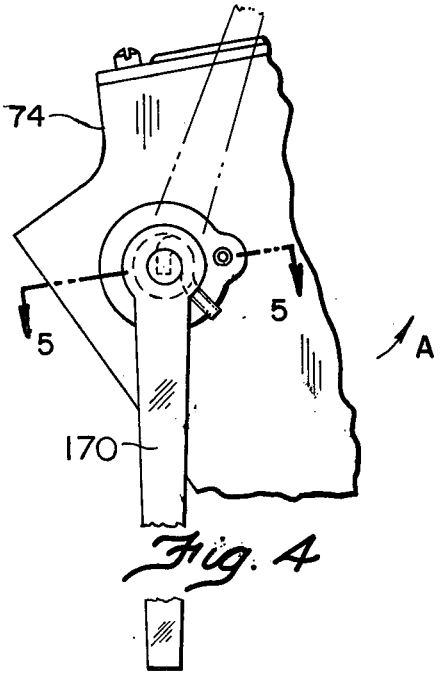
FIG. 4 is a detailed view of the valve reset handle mounted on the coupler.

The manual resetting of the valve member 32 to the latched position is achieved by movement of the reset handle 170 (FIG. 4, 5). The handle 170 has a boss portion 172 at the upper end thereof which is pinned by means of a pin 174 to the end of the shaft 156. A coil spring 176 has one end pinned to the head 74 by means of a pin 178 and the other end 180 is secured to the shaft 156. Rotation of the handle 170 in the direction of the arrow A in FIG. 4 to the chain line position shown in FIG. 4 tightens the coil spring 176. A pin 182 (FIG. 3) projects radially outwardly from the shaft 156 and is secured thereto. A plate 184 projects laterally from the arm 154 of the valve member 32. As indicated in FIG. 4 of the drawings, the handle 170 will rest in the solid line position and will be returned automatically to the solid line position by the spring means after the resetting of the vale member in the latched position. When the valve member 32 is in the closed position shown in broken lines in FIG. 3, rotation of the shaft 156 in response to movement of the handle 170 in the direction of the arrow A will cause the pin 182 to engage the plate 184 so that the valve member 32 will be moved to the latching position in response to rotation of the handle 170.

In use, the operator arrives at a drop location and he connects the coupler to the adapter and thereby locates the vacuum probe 36 in the vacuum receiver 56. The operator then moves the handle 170 from the position shown in solid lines in FIG. 4 to the position shown in chain lines in FIG. 4, thereby ensuring that the valve member 32 is located in the latched position. The operator then opens the valve 16 (FIG. 1) and liquid flows from the compartment 12 of the tank truck to the underground storage tank. The passage of liquid through the through passage 106 in the coupler draws a vacuum in the line 104. Atmosphere from within the underground storage tank is drawn into the vacuum passage 104 through the first vent passage means which consists of the passages 102 and 100 formed in the head and the passage 98 formed in the vent probe 36, the passages 68,70 and 52 formed in the probe receiver and its associated sealing ring and the passages 50 formed in the upper end of the drop tube and the passage 72 formed between the drop tube 26 and the liner tube 46. Atmosphere will continue to be supplied to the vacuum passage 104 through this system of passages until the level of liquid in the storage tank rises above the lower end of the inner tube 46. As a routine in the delivery, the operator is able to determine whether or not the automatic release of the latching mechanism is functioning properly by manually depressing the valve member 92. This closes the upper end of the vacuum probe member 80 and thereby interrupts the venting communication between the vacuum passage 104 and the storage tank. As a result of the closing of the passage 98, the vacuum drawn in the line 104 is transmitted through the passage 40 of the head to the diaphragm chamber 116 and the latching mechanism is thereby activated as previously described to release the valve member to permit it to fall to the closed position. The valve member 32 will then be located in a position bearing against the valve seat 152, thereby interrupting the flow of liquid through the passage 104. Having determined that the latching mechanism is operating satisfactorily, the operator may release the valve 92 which will move to the open position under the influence of the spring 94 and then manually reset the valve 32 to the latched position by moving the handle 170 as previously described. This gives the operator an indication that the latching mechanism is operating satisfactorily. After the valve 32 has been reset in the open position, liquid will continue to flow into the tank 28 until the level rises above the lower end of the liner tube 46 whereupon the lower end of the passage 72 will be closed to prevent atmosphere being drawn from the underground storage tank to the vacuum passage 104. This will again activate the latching mechanism in the same manner as that described when the valve 92 is closed to release the valve member to permit the valve member 32 to move to the closed position shown in broken lines in FIG. 3. Consequently, when the level of liquid in the underground storage tank rises above the lower end of the liner 46, the valve member 32 will be automatically released and will fall to automatically close the through passage 106 and thereby stop the flow of liquid into the storage tank.

It has been found that an adequate vacuum is drawn in the vacuum line 104 of the coupler in response to the passage of liquid unloading from the tank truck under the influence of gravity into the underground storage tank.

Various modifications of the present invention will be apparent to those skilled in the art without departing from the scope of the invention. For example, it may be possible to dispense with the vacuum passage 104 which is formed in the body and to communicate directly with the interior of the coupler by means of an orifice opening through the wall of the vacuum probe member 36. This would have the disadvantage of locating the vacuum line downstream of the valve mechanism 88 so that it would not be possible to test the system in the manner previously described. These and other modifications of the present invention will be apparent to those skilled in the art.

What we claim as our invention is:

1. In a liquid loading system for the gravity loading of a liquid storage tank from a tank truck having at least one liquid shipping compartment, the improvement of;

a. a normally open substantially unrestricted liquid fill line in which a partial vacuum is drawn in response to the passage of liquid therethrough under the influence of gravity, said fill line opening from the shipping compartment and being connected to a liquid input passage of the liquid storage tank, b. valve means in said line movable between an open position in which said line is open to permit the flow of liquid therethrough and a closed position in which said line is closed to interrupt the flow of liquid to the storage tank, said valve means being normally open and urged to said closed position, c. pressure responsive latch means engaging said valve means and releasably locking said valve means in said normally open position, d. vent passage means having a first end communicating with said pressure responsive latch means and a second end opening into said storage tank at a predetermined level below the upper end of the tank, e. vacuum passage means communicating between said pressure responsive latch means and a vacuum source in said fill line whereby the flow of liquid through the fill line during the filling of the storage tank draws a vacuum in the vacuum passage at the vacuum source which is insufficient to activate said pressure responsive latch means to retain said valve means in the open position until the level of liquid in the storage tank rises to close said other end of said vent line whereupon the full vacuum is applied to the pressure responsive latch means thereby releasing the valve which moves to its normally closed position.

2. In a liquid loading system for gravity loading of a liquid storage tank from a tank truck wherein a filling hose of the tank truck is connected by means of a coupler to a fill adapter at the input opening of the storage tank, the improvement of, a. first vent means mounted at said input opening of said liquid storage tank and having a first vent passage opening therethrough between an upper end adjacent said input opening and a lower end disposed at a predetermined level below the upper end of the tank, b. said coupler member having an inlet end and an outlet end and a substantially unrestricted through passage extending therebetween, said outlet end being adapted to be releasably connected to said adapter to connect the through passage thereof to the input opening of the adapter, c. second vent means mounted on said coupler and having a second vent passage extending therethrough between a first end and a second end thereof, said first end of said second vent passage being releasably connected to said upper end of said first vent passage when said coupler is connected to said adapter, d. a vacuum passage opening outwardly from said second vent means to communicate between said second vent passage and the through passage of the coupler whereby the flow of liquid through the through passage of the coupler during filling of the tank draws a vacuum in the second vent passage means which is normally relieved from within the storage tank by way of the first vent passage, e. valve means in said coupler movable between an open position wherein the through passage of the coupler is open and a closed position closing said through passage, f. pressure responsive latch means mounted on said coupler for releasably latching said valve member in said open position, said latch means being operable in response to the application of a predetermined vacuum pressure thereto to release the valve member from its open position to permit it to move to said closed position, g. said pressure responsive latch means communicating with said second end of said second vent passage such that when the rising level of liquid in the tank closes said lower end of said first vent passage, the full vacuum will be drawn on the pressure responsive latching means to activate the latching means to release the valve and the valve will close the through passage of the coupler, and h. means for resetting the latch means to releasably retain the vlave in the open position.

3. A liquid loading system as claimed in claim 2 wherein said first vent passage means includes a vacuum probe receiver mounted coaxially with respect to said adapter and said second vent means includes a vacuum probe mounted within said coupler and extending coaxially with respect to said outlet end of said coupler to sealingly engage said vacuum probe receiver when said coupler is connected to said adapter.

4. A liquid loading system as claimed in claim 2 wherein said adapter is mounted at the upper end of a riser pipe which opens upwardly from the storage tank and a drop rube extends downwardly from the adapter in an inwardly spaced relationship with respect to the drop tube, the improvement wherein said first vent means comprises a. a vacuum probe receiver tube mounted coaxially within the upper end of said drop tube by means of at least one rib extending radially inwardly from the drop tube, said vacuum probe receiver tube opening upwardly, b. a liner tube extending downwardly from the adapter coaxially outwardly of the drop tube to form a passage therebetween which terminates at said predetermined level within the tank, c. said first vent passage extending longitudinally downwardly from the upper end of said drop tube and radially outwardly through said radially extending arm and opening into the passage formed between the liner tube and the drop tube to terminate at said predetermined level within the tank.

5. A liquid loading system as claimed in claim 4 wherein said second vent passage means includes a tubular vacuum probe mounted at its upper end in said coupler and projecting coaxially with respect to said outlet end of said coupler and adapted to fit within the open upper end of said vacuum probe receiver tube.

6. A liquid loading system as claimed in claim 1 including normally open manually operable second valve means in said vent passage means, said manually operable valve means being movable to a closed position to close said vent passage means to release said latching means as required to test the operation of said pressure responsive latch means.

7. A liquid loading system as claimed in claim 5 including normally open manually operable second valve means in said vent passage means, said manually operable valve means being movable to a closed position to close said vent passage means to release said latching means as required to test the operation of said pressure responsive latch means.

* * * * *